United States Patent [19]

Miller

[11] 4,249,702

[45] Feb. 10, 1981

[54] PRODUCE STALK CUTTER

[76] Inventor: Charles E. Miller, 974 Mader St. SE., Salem, Oreg. 97302

[21] Appl. No.: 33,141

[22] Filed: Apr. 25, 1979

[51] Int. Cl.[3] ..... B02C 18/26

[52] U.S. Cl. ..... 241/205; 241/206; 241/252; 241/283

[58] Field of Search ..... 241/283, 205, 228, 229, 241/251, 252, 91, 87, 85, 86, 86.2, 88.4, 93, 206; 99/636–639, 641

[56] References Cited

U.S. PATENT DOCUMENTS

| | | | |
|---|---|---|---|
| 287,876 | 11/1883 | Shimer | 241/228 X |
| 911,108 | 2/1909 | Beienburg | 241/89.3 |
| 1,351,143 | 8/1920 | Vaudreuil | 99/636 |
| 1,428,687 | 9/1922 | Ferencz | 241/228 |
| 1,537,377 | 5/1925 | Rousseau | 241/228 X |
| 1,831,642 | 11/1931 | Witham, Jr. | 241/93 X |
| 3,010,498 | 11/1961 | Carlson | 99/636 |
| 3,059,648 | 10/1962 | Burton | 99/638 X |
| 3,164,328 | 1/1965 | Van Dornick | 241/229 X |
| 3,378,051 | 4/1968 | Grosbety | 99/637 |
| 3,877,651 | 4/1975 | Harris | 241/86.2 X |

*Primary Examiner*—Mark Rosenbaum
*Attorney, Agent, or Firm*—Kolisch, Hartwell & Dickinson

[57] ABSTRACT

Apparatus for cutting clustered produce stalks. The apparatus includes a cylindrical produce-receiving chamber which is mounted for rotation about a first axis, and a cylindrical blade carrier which is mounted outside of, and adjacent the produce-receiving chamber for rotation about a second axis offset from, and substantially parallel to the first axis. A plurality of blades mounted on the carrier extend radially through suitable blade-receiving apertures in the produce-receiving chamber. Further included is a powered shaft for rotating the chamber and the carrier at the same speed, with such rotating producing generally radially directed, recurrent reciprocation of each blade relative to its associated aperture. In operation, produce stems and stalks become captured in notches formed in the blades, and are drawn against the inner surface of the produce-receiving chamber and cut as the reciprocating blades retract through associated apertures.

10 Claims, 5 Drawing Figures

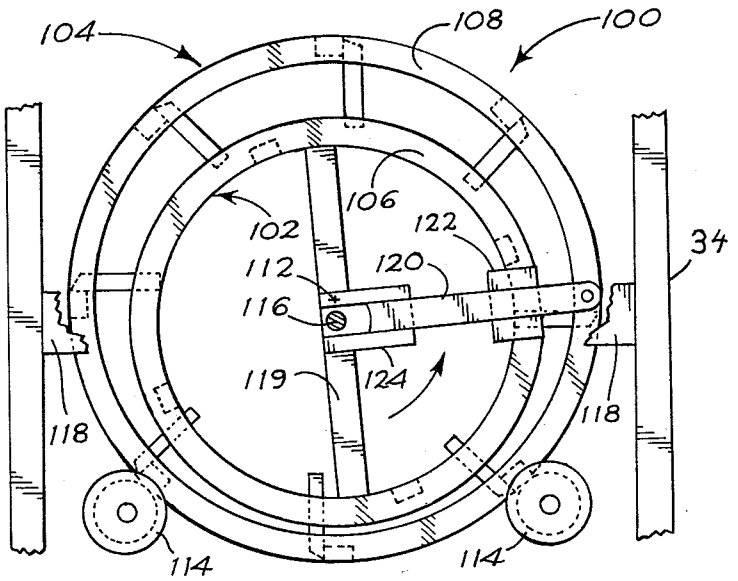
Fig. 5.
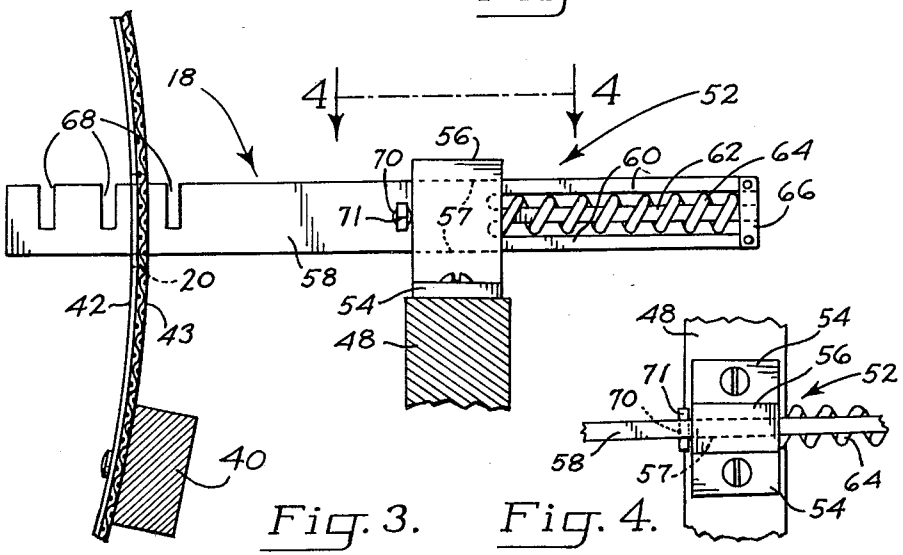
Fig. 3.
Fig. 4.
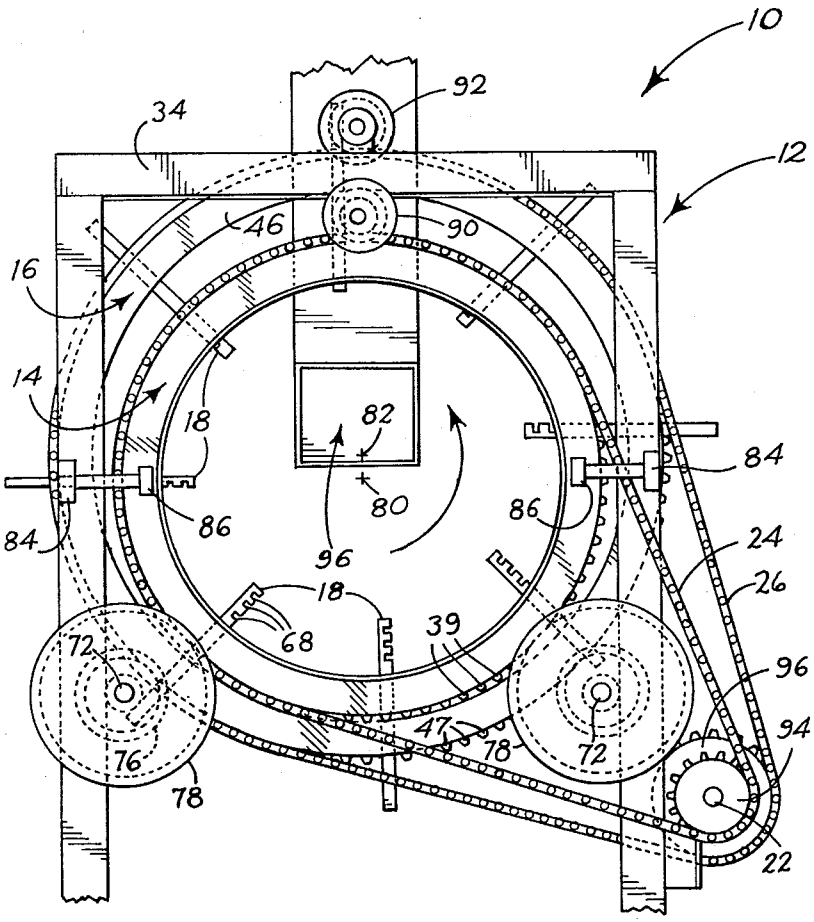
Fig. 2.

PRODUCE STALK CUTTER

BACKGROUND AND SUMMARY

The present invention relates to apparatus for cutting produce stems and stalks, and in particular, to such apparatus which operates by the action of notched blades reciprocating within a rotating produce-receiving chamber.

Mechanical fruit and vegetable harvesters are being used increasingly in harvesting such diverse produce as beans, tomatoes and strawberries. In general, produce harvesters operate by removing the entire plant or large parts thereof from the ground rather than by picking selectively the produce crop from the plant, as is done in hand picking. Once the plant has been severed or pulled up by the harvester, it must be further processed to cut or otherwise separate the produce from the remaining stem, stalk and leafy material of the plant.

An important operational characteristic of plant-producing apparatus designed for severing produce from remainder portions of a plant is that the severing be done without injuring the produce. Secondly, because such apparatus typically could be mounted on a mechanical harvester, and work in conjunction therewith, the apparatus should be durable and simple in construction. A further desirable feature is that the apparatus have a processing capacity equaling the capacity of the harvester to which the apparatus is attached.

One object of the present invention is to provide apparatus capable of severing plant produce from remainder parts of harvested plants, without producing significant injury to the produce.

Another object of the invention is to provide a durable, high-capacity plant-processing apparatus suitable for use with a mechanical harvester.

A further object of the present invention is to provide plant-processing apparatus having a plurality of blades which can be interchanged to adapt the machine to different plant-processing or cluster-cutting operations.

The present invention includes a revolvable produce-receiving chamber having a plurality of blade-receiving apertures spaced around its outer wall, and a revolvable blade carrier mounted outside of, and adjacent the chamber. The carrier includes plural elongate blades extending substantially radially through associated aperture into the chamber. The chamber is revolvably coupled to the carrier, wherein revolution of the chamber or the carrier produces related revolution of the carrier or the chamber, respectively, with such revolution producing generally radially directed, recurrent reciprocation of each blade relative to its associated aperture.

According to one embodiment of the present invention, the produce-receiving chamber is cylindrical, and is mounted for rotation about a first, slightly inclined axis. The blade carrier is mounted for rotation about a second axis which is offset from, and substantially parallel to, the first axis. The carrier and chamber are rotatably driven, at the same speed, by a power-driven shaft rotatably coupled to each.

The blades employed in the present invention may be interchangeable to adapt the apparatus to process different types of produce. More particularly, the blades are rigid bands having transversely extending notches formed therein, with the size and edge characteristics of the notches varying according to the produce to be processed.

In operation, harvested plant material is introduced into one end of the produce-receiving chamber, while the same is corotating with the carrier. The plant material, and particularly the stalks and stems connecting the produce to the plant, become captured in the knife notches, and are cut as the knives retreat through associated chamber apertures. The plant material encounters plural axially spaced arrays of blades and thereby is cut successively as it passes axially through the chamber.

These and other objects and features of the present invention will become more fully apparent when considered with the following detailed description of preferred embodiments of the present invention and the accompanying figures, wherein:

FIG. 2 is a front view of the apparatus of FIG. 1, taken generally along 2—2 in FIG. 1.

FIG. 3 is an enlarged sectional view of a blade and blade-mounting bracket employed in the present invention, taken generally along line 3—3 in FIG. 1.

FIG. 4 is a fragmentary view of the blade and blade mounting bracket of FIG. 3, taken generally along line 4—4 in this figure.

FIG. 5 is a front view, similar to the view of FIG. 2, of an alternate embodiment of the invention.

DETAILED DESCRIPTION OF PREFERRED EMBODIMENTS OF THE INVENTION

Figure 1:
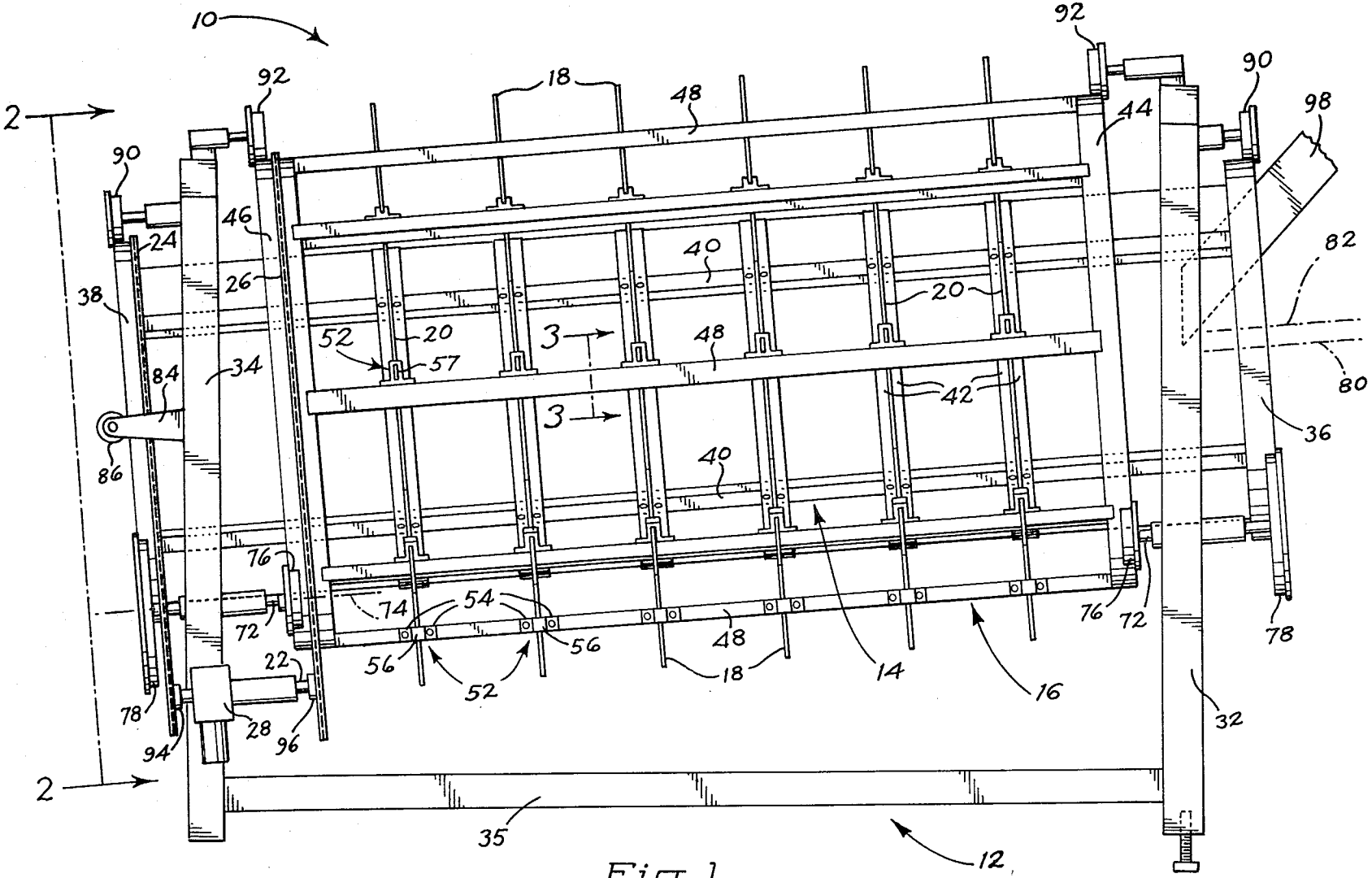
FIG. 1 is a side view of a cluster-cutting apparatus constructed according to the present invention, shown in somewhat simplified form.

Looking first at FIGS. 1 and 2, there is shown at 10 a cluster cutting apparatus constructed according to a preferred embodiment of the invention. Apparatus 10 generally comprises a frame 12 having revolvably mounted thereon a generally cylindrical produce-receiving chamber 14, and a cylindrical blade carrier 16 which is mounted outside of, and adjacent this chamber. A plurality of blades, such as blades 18 mounted on carrier 16, extend substantially radially through associated apertures, such as apertures 20 formed in the chamber wall, as will be detailed below. As seen in FIG. 1, the blades and associated apertures are arranged in plural, longitudinally spaced arrays along the long axes of the carrier and chamber, with each array including plural angularly spaced blades and associated aperatures.

A power-driven shaft 22 coupled to chamber 14 through endless chain 24 and to carrier 16, through endless chain 26 serves to revolve the carrier and chamber at substantially the same speed. Shaft 22 is powered by a reversible-direction motor 28 attached to the frame. As will become clear below, revolution of chamber 14 and carrier 16, about parallel, offset rotational axes, at substantially the same speed, produces recurrent reciprocation of each knife relative to its associated aperture 20.

Considering now details of the invention, frame 12 includes a pair of opposed frame ends 32, 34, which rotatably support opposed ends of chamber 14 and carrier 16, in a manner to be described. The two frame ends, which have the generally inverted-U-shape construction shown in FIG. 2, are joined together by beams, such as beam 35 (FIG. 1) to form a unitary frame.

Chamber 14 includes a frame which is formed of a pair of opposed, annular end members 36, 38 defining chamber infeed and outfeed openings, respectively, and a plurality of axially extending, angularly spaced longitudinal members, such as members 40, rigidly joining the two end members. As seen best in FIG. 2, member 38 takes the form of a sprocket having gear teeth, such as teeth 39, spaced thereabout for engaging chain 24. Attached to members 40, at the longitudinally spaced intervals corresponding to the above-mentioned longitudinally spaced blade arrays, are plural pairs of annular metal strips, such as strips 42 (FIGS. 1 and 3). The axial spacing between strips 42 of each pair is dimensioned to accommodate the width of an associated blade 18 projecting therethrough. Thus, each pair of strips defines plural angularly spaced apertures 20, with each aperture having an arcuate dimension defined by the arcuate distance between adjacent members 40. The cylindrical wall of chamber 14 is formed of a wire mesh screen 43 (FIG. 3) which extends between end members 36, 38, attached to members 40 and strips 42. Screen 43 is attached to members 40 at suitable angularly and longitudinally spaced intervals, and is slotted where the same coextends with apertures 20.

Carrier 16 generally includes a pair of opposed annular end members 44, 46 which encircle chamber 14 and which are adjacent the infeed and outfeed ends thereof, respectively. Like member 38, member 46 takes the form of a sprocket having gear teeth, such as teeth 47, spaced thereabout for engaging chain 26. Members 44, 46 are rigidly joined by plural parallel longitudinal members, such as members 48, (FIG. 1) which are angularly offset from members 40, as shown.

Blades 18 are mounted on members 48 at the longitudinally and radially spaced positions shown in FIGS. 1 and 2, respectively, by blade-mounting brackets, such as brackets 52 seen in FIG. 1, one of which is detailed in FIGS. 3 and 4. With reference to FIGS. 1, 3 and 4, each bracket 52 includes opposed base portions 54 by which the bracket is attached to associated member 48, and a projecting portion 56 defining a radially extending guideway 57.

As seen in FIG. 3, each blade 18 is formed of an elongate rigid band 58, the right portion of which in FIG. 3 is a three-prong structure including outer prongs 60 and a central prong 62. A compression spring 64 encircling prong 62 is held thereon at its right end in this figure, by a fastener 66 attached to, and joining the prongs' right ends.

Plural notches 68 are formed along the left portion of band 58 in FIG. 3. The left edges of notches 68 in this figure may be sharpened to form cutting edges, or they may be be blunt, depending on the type of cutting or tearing action desired, as will be explained below.

To mount blade 18 on associated bracket 52, band 58 is inserted through slot 57, and a cotter key 71 is locked in a suitable opening 70 in the blade, as seen best in FIG. 4. In its mounted position shown in FIGS. 3 and 4, spring 64 is slightly compressed, biasing key 71 against the left edge of bracket portion 56, thus to hold blade 18 securely within the bracket. It can be appreciated with reference to FIG. 3 that the just-described construction and mounting of blade 18 permits the same to shift in a right-to-left direction in FIG. 3, against the action of spring 64, for a purpose still to be described.

The rotatable mounting of chamber 14 and carrier 16 on frame 12 will now be described. With reference to FIGS. 1 and 2, each frame end 32, 34 mounts, at a lower portion thereof, a pair of transversely spaced support shafts 72. Shafts 72 are mounted for rotation about parallel axes, such as the axis indicated by dash-dot line 74 in FIG. 1, which axes are inclined slightly with respect to the horizontal. Each shaft has attached, for rotation therewith, at its inwardly facing end, a smaller-diameter roller 76, and at its outwardly facing end, a larger-diameter roller 78. Rollers 76, 78 are flanged, forming recessed inwardly facing shoulders, as seen in FIG. 1, with the longitudinally spaced pairs of rollers 76 being spaced apart a distance to receive, on their shoulders, opposed annular edge portions of carrier members 44, 46 and longitudinally spaced pairs of rollers 78 being spaced apart a distance to receive, on their shoulders, opposed annular edge portions of chamber members 36, 38. The diameters of rollers 76, 78 relative to the diameters of carrier 16 and chamber 14, are such that, with the carrier and chamber mounted as just-described, chamber 14 rotates about an axis, indicated by dash-dot line 80 in FIG. 1, which is parallel to axis 74, and carrier 16 rotates about a second axis, indicated by dash-dot line 82 in FIG. 1, which is offset from, and parallel to, axis 80.

With reference to FIG. 1, it can be appreciated that the flanged portions of opposed pairs of rollers 76, 78 act to prevent axial shifting of the carrier and chamber during operation. Further to prevent gravity-assisted shifting of chamber 14 in a right-to-left direction in FIG. 1, there is provided a pair of end thrust idlers 84 attached to opposed sides of frame end 34, as seen in FIG. 2. Each idler includes a roller 86 mounted for rotation about an axis which preferably extends through chamber rotational axis 80, and is perpendicular thereto. Rollers 76, 78 and idlers 84 are also referred to herebelow as means for resisting axial movement of the chamber and carrier.

Completing the description of the mounting of chamber 14 and carrier 16 on frame 12, each frame end 32, 34 has rotatably mounted thereon, for rotation about axes paralleling axis 74, hold-down rollers 90, 92. As seen in FIGS. 1 and 2, rollers 90, 92 are positioned to engage rotatably upper annular edge portions of chamber members 36, 38 and carrier members 44, 46, respectively, thus to hold chamber 14 and carrier 16 against lower rollers 78, 76 respectively. This, in turn, maintains rotation of the chamber and carrier about their axes 80, 82, respectively, during operation of the apparatus.

Considering now the manner by which chamber 14 and carrier 16 ae rotatably driven, shaft 22 carries at its left end in FIG. 1 a smaller-diameter sprocket 94 which is coupled to chamber end member 38 through chain 24. The right end of shaft 22 in FIG. 1 carries a larger-diameter sprocket 96 which is similarly coupled to end member 46 through chain 26. As can be appreciated with reference to FIG. 2, the ratio of teeth in sprockets 94, 96 is such that as shaft 22 is driven by motor 28, chamber 14 and carrier 16 rotate at the same rate. Shaft 22 is also referred to herein as powered shaft means, and shaft 22, attached sprockets 94, 96 and chains 24, 26, respectively, are also referred to herein as means operatively connecting the chamber and the carrier collectively for producing, in response to revolution of the carrier (or the chamber) related revolution of the chamber (or the carrier).

Viewing FIG. 2 it can be appreciated that the parallel offset relationship between the rotational axes of chamber 14 and carrier 16 produces a radial asymmetry between the two, wherein lower portions of the chamber and carrier are spaced more closely together than the upper portions thereof. Consequently, blades 18 positioned adjacent lower portions of carrier 16 project substantially further into chamber 14, through associated apertures 20, than do blades positioned adjacent upper portions thereof. Thus, as the carrier and chamber rotate, in the same direction, at the same speed, such rotation produces recurrent reciprocation of each blade relative to its associated aperture. The reciprocation cycle for each blade occurs over one complete revolution of the chamber and carrier.

Completing the description of what is shown in FIG. 1, an infeed chute 98 attached to frame end 32, and extending, at its left end in FIG. 1, into chamber 14, is used for introducing harvested plant material into the chamber.

The operation of apparatus 10 will now be described. Initially, the apparatus is provided with blades 18 suitable for the particular plant-processing or cluster-cutting operation to be performed. Specifically, the sizes and cutting edges associated with blade notches 68 will vary according to the plant material to be processed. As an example, when apparatus 10 is to be used for processing bean clusters, notches 68 are dimensioned to allow the cluster stalks, but not the larger beans, to be received easily therein. Further, the left edges of notches 68 in FIG. 3, are cutting edges, wherein the captured stalks are severed during machine operation, as will be described. As a further example, when the apparatus is to be used to remove the cluster stems from cherries, the left edges of notches 68 in FIG. 3 are blunt, wherein such stems will be pulled off of the fruit, rather than being severed. It is noted here that notches may be formed on both sides of blades 18, with the notches formed on one side being adapted to process one type of plant material, and the notches of the other side being adapted to process a second type of plant material.

Referring now to FIG. 1, plant material which is to be processed in apparatus 10 is fed into the elevated, infeed end of the apparatus chamber, through chute 98. As the chamber rotates, in a counterclockwise direction, as viewed in FIG. 2, the plant material is carried upwardly along the side walls of the chamber, then falls back, under gravity, to become captured in notches of the rotating blades. With reference to FIG. 2, continued rotation of the chamber produces reciprocation of the blades relative to their associated apertures, as described above, with such reciprocation drawing captured plant material against strips 42 forming such apertures. When this occurs, the strips brace the captured plant material firmly while the capturing blade continues to retract through the aperture, causing the plant material to be severed. It is noted with reference to FIG. 3, that if wire or other non-severable material becomes captured in a blade notch, radial movement of the blade, relative to carrier 16, through biasing of spring 64, prevents damage to the apparatus. As the plant material migrates from the infeed toward the outfeed end of the chamber, under the influence of gravity, the plant material encounters successive arrays of blades, wherein the plant material undergoes continued cutting or severing. The separated produce and plant material which emerges from the outfeed end of the chamber may be collected and separated by conventional methods.

From the above, it can be appreciated how various objects of the invention are met. First, the apparatus described herein is effective in cutting selectively only non-produce portions of plant material, with the produce being excluded selectively from the cutting action of the apparatus by exclusion from the blade notches. As plant material undergoes successive cutting in moving from the infeed to the outfeed end of the rotating chamber, portions of plant stalks attached to the produce become selectively cut away, leaving the produce cleanly separated from non-produce parts of the plant, and unharmed.

Secondly, the cutting action of the apparatus—involving recurrent reciprocation of a plurality of angularly spaced notched blades within a rotating produce-receiving chamber—is achieved through a simple construction described herein. Accordingly, the apparatus is relatively inexpensive in construction, and easily maintained in operation. The simplicity of the apparatus also contributes to its durability.

Thirdly, the apparatus of the present invention has a high capacity, due in part to the high volume capacity of the produce-receiving chamber, and to the fact that, at any instant, a large portion of the material in the chamber is being acted upon by the plural blades arranged axially along the chamber. In a typical cluster-cutting apparatus as described herein, the diameter of the produce-receiving chamber is about 50-inches. At a typical rotational speed of about 18 r.p.m., the cluster cutter is capable of processing up to five tons of harvested plant material per hour.

Finally, as noted above, the blades employed in the present invention may be notched on both sides, with notches on one side of the blade—facing one direction of chamber rotation—being adapted to process one type of plant material, and notches on the other side of the blade—facing the direction of opposite chamber rotation—being adapted to process another type of plant material. Accordingly, it is only necessary to reverse the direction of the rotation of the chamber and carrier, by reversing the direction of power-driven shaft 22, to adapt the machine to process a second type of plant material.

FIG. 5 shows in front view cluster-cutting apparatus, indicated here at 100, constructed accorded to a second embodiment of the invention. Apparatus 100 differs from apparatus 10 above described in that the rotation of the produce-receiving chamber, indicated here at 102, is directly coupled in a manner to be described, to the blade carrier, indicated here at 104. Only those features of apparatus 100 which differ from apparatus 10 will be described herein.

In FIG. 5, there is seen the outfeed end members 106, 108 of chamber 102 and carrier 104, respectively. Similar to apparatus 10, carrier 104 is mounted, at its opposed ends, for rotation about an inclined axis, indicated here at 112, on four longitudinally and laterally spaced rollers, such as rollers 114. At least one pair of longitudinally spaced rollers 114 is power-driven by a reversible motor (not shown) with carrier 104 being driven in a selected direction by this pair.

Chamber 102 is rotatably mounted on an axially extending shaft, indicated cross-sectionally at 116—this shaft being supported at its opposite ends by opposed frame-mounted, transversely extending cross bars, such as the bar 118 shown fragmentarily in FIG. 5. Chamber 102 is journaled on shaft 116 through an opposed pair of cross bars, such as cross bar 119, each of which is connected, at its opposite ends, to diametrically opposed regions of associated end member 106, as shown. Shaft 116, which defines the axis of rotation of chamber 102, is parallel to and spaced below rotational axis 112 of carrier 104, with the relative spacing between the two just-mentioned rotational axes being similar to that between axes 80, 82 described with reference to apparatus 10.

Chamber 102 is rotatably coupled to carrier 104 by a cross bar 120 which is pivotally attached, at its right end in FIG. 5, to carrier end member 108. Bar 120 is slidably received within a track formed by a pair of slotted members 122, 124. Member 122 is rigidly secured to chamber end member 106 adjacent the attachment of bar 120 to end member 108, and member 124 is rigidly secured to cross member 119, as shown. The track formed by the two just-mentioned slotted members serves as means for maintaining bar 120 longitudinally aligned between its point of coupling to member 108, and shaft 116 about which chamber 102 rotates.

At the relative positions of the chamber and carrier shown in FIG. 5, bar 120 is angularly offset from the line extending between the point of coupling of bar 120 to member 108 and axis 112. As the carrier is rotated, by the rotation of power-driven rollers 114, bar 120, acting against members 122, 124 produces related rotation of chamber 102 about shaft 112. With the carrier rotated 90 degrees counterclockwise from the position shown in FIG. 5, bar 120 becomes aligned longitudinally between its point of pivotal coupling to member 108 and axis 112. The small angle through which bar 120 pivots as the carrier rotates 90 degrees produces a similar small angle variation in the relative angular positions of carrier 104 and chamber 102. Thus, unlike apparatus 10, wherein the carrier and chamber are maintained in angular coincidence throughout rotation of both, in apparatus 100, the angular position of the carrier, relative to the chamber, oscillates about a small angle with each revolution of the two.

While two specific embodiments of a cluster-cutting apparatus have been disclosed herein, it is apparent that various changes and modifications may be made without departing from the spirit of the invention.

I claim:

1. Apparatus for cutting clustered produce stalks comprising means defining a revolvable produce-receiving chamber having a wall including blade-receiving apertures, a blade carrier mounted outside of said wall for revolution therewith about an axis offset with respect to the revolution axis of said chamber-defining means, for each of said apertures, an elongate blade mounted on said blade carrier extending substantially radially through the aperture into said chamber, and means operatively interconnecting said carrier and said chamber-defining means for producing, in response to revolution of one of said carrier and chamber-defining means, related revolution of the other, with such producing generally radially directed, recurrent reciprocation of each blade relative to its associated aperture.

2. The apparatus of claim 1, wherein said chamber and said carrier are mounted for rotation about first and second offset, substantially parallel axes, respectively.

3. The apparatus of claims 1 or 2, wherein said interconnecting means includes powered shaft means operatively connected to said chamber and to said carrier for revolving the two at substantially the same speed.

4. The apparatus of claims 1 or 2, wherein said interconnecting means includes an elongate bar mounted, adjacent one of its ends, on one of said two defining means for pivoting about an axis substantially parallel to the rotational axes of the two defining means, and guide means mounted on the other of said two defining means for maintaining said bar at a substantially fixed angular orientation with respect to said other means.

5. Apparatus for cutting clustered produce stalks comprising means defining a produce-receiving chamber mounted for rotation about a first axis, and having a wall including blade-receiving apertures, a blade carrier mounted outside of said wall for rotation with said chamber about a longitudinal axis extending through said chamber offset from and substantially parallel to said first axis, for each of said apertures, an elongate blade mounted on said carrier extending substantially radially through the aperture into said chamber, and powered shaft means operatively connected to said chamber and to said carrier for rotating the two at substantially the same rotational speed and in the same direction, with such producing generally radially directed, recurrent reciprocation of each blade relative to its associated aperture.

6. The apparatus of claim 5 wherein each blade includes a spring, and is mounted on said carrier for movement relative thereto in a substantially radially inward direction, against the force of said spring.

7. The apparatus of claim 5, wherein said blades include notches facing the direction of chamber rotation.

8. The apparatus of claim 7 wherein said powered shaft means is selectively operable to rotate both said chamber and said carrier, in one direction and the other, and wherein said blades include notches facing both directions of chamber rotation.

9. The apparatus of claim 7 which further includes means mounted adjacent said outfeed end for resisting axial movement of said chamber and carrier.

10. The apparatus of claim 5, wherein said chamber includes an open outfeed end, and an open infeed end which is elevated with respect to said outfeed end.

* * * * *